US005082118A

United States Patent [19]

Rintala et al.

[11] Patent Number: 5,082,118

[45] Date of Patent: * Jan. 21, 1992

[54] DEVICE FOR SEPARATING HARD OBJECTS, SUCH AS STONES, FROM A STREAM OF WOOD

[75] Inventors: Kari Rintala, Helsinki; Jyrki Paarma, Soramaki; Mikko Sissala, Hyvinkaa; Ilkka Valkonen, Lahti; Pekka Kokko, Hollola, all of Finland

[73] Assignee: Kone Oy, Finland

[ * ] Notice: The portion of the term of this patent subsequent to Sep. 11, 2007 has been disclaimed.

[21] Appl. No.: 580,280

[22] Filed: Sep. 10, 1990

Related U.S. Application Data

[63] Continuation-in-part of Ser. No. 314,541, Feb. 23, 1989, Pat. No. 4,955,541.

[30] Foreign Application Priority Data

Feb. 29, 1988 [FI] Finland ..... 880930

[51] Int. Cl.[5] ..... B01C 5/34

[52] U.S. Cl. ..... 209/599; 73/587; 209/518

[58] Field of Search ..... 209/517, 518, 520, 590, 209/599, 698, 941; 73/579, 587; 340/674; 193/35 R

[56] References Cited

U.S. PATENT DOCUMENTS

| | | | |
|---|---|---|---|
| 2,208,202 | 7/1940 | Stanton et al. | 209/590 |
| 2,593,089 | 4/1952 | Barry | 193/35 R |
| 3,394,806 | 7/1968 | Vaillette | 209/590 |
| 3,559,805 | 2/1971 | Cragg | 209/599 X |
| 4,147,620 | 4/1979 | Artiano | 209/590 |
| 4,309,903 | 1/1982 | Ono | 73/587 |
| 4,602,716 | 7/1986 | Barla-Szabo | 209/599 |
| 4,955,484 | 9/1990 | Rintala et al. | 209/518 X |

FOREIGN PATENT DOCUMENTS

| | | | |
|---|---|---|---|
| 285255 | 9/1966 | Australia | 209/599 |
| 1145702 | 3/1969 | United Kingdom | 209/599 |

*Primary Examiner*—Donald T. Hajec

*Attorney, Agent, or Firm*—Lerner, David, Littenberg, Krumholz & Mentlik

[57] ABSTRACT

A device is disclosed for separating hard objects, such as stones, from a stream of wood in an apparatus for conveying or manipulating logs or blocks of wood including a conveyor section. The device includes a transducer disposed in a location suited for the detection of vibration. The transducer registers acoustic vibrations and is connected to a control unit by means of which hard objects conveyed along with the wood stream can be detected on the basis of the vibration signals they generate. The control unit is also used to control an exit gear incorporated in the conveyor section, so that hard objects which are detected will fall down from the stream of wood passing through the apparatus. The invention eliminates the need to build water-operated stone catchers as conventionally used for the removal of stones.

15 Claims, 4 Drawing Sheets

DEVICE FOR SEPARATING HARD OBJECTS, SUCH AS STONES, FROM A STREAM OF WOOD

CROSS REFERENCE TO RELATED APPLICATION

This application is a continuation-in-part of our application Ser. No. 314,541, filed Feb. 23, 1989, now U.S. Pat. No. 4,955,484.

FIELD OF THE INVENTION

This invention relates to a device for separating hard objects, such as stones, from a stream of wood in an apparatus conveying or manipulating logs or blocks of wood.

DESCRIPTION OF THE PRIOR ART

In wood processing plants, such as saw mills and pulp mills, conveyors are generally used for the transportation of logs and blocks of wood. When stones, metal objects or other hard objects carried along with the wood stream on the conveyors get into a processing machine, e.g. a chipper, this often leads to a shutdown in production and necessitates repairs. Therefore, it is important that hard objects be removed from the stream of wood prior to further processing thereof.

Furruginous objects carried with the wood can be detected, e.g. by means of metal detectors. In order to remove stones from a stream of wood, a common method has been to use a stone catcher built in connection with the conveyor. The stone catcher is a basin filled with water, over which the wood stream is passed, so that the stones, having a higher specific gravity, sink to the bottom of the basin.

In order to prevent the wet wood from sinking with the stones, additional water is supplied from the bottom of the basin to produce an upward flow. The water exits the basin at its top edges as an overflow and is collected and recirculated. Before recirculation, the water must be purified to remove the bark and other refuse carried into the basin with the wood. However, the heavy logs and blocks of wood cannot always be prevented from sinking, and an additional drawback is the complex water supply and purification system which is otherwise unnecessary in a modern wood processing plant employing a dry debarking method.

So far, no solution has been proposed for the separation of stones without the use of water in an apparatus manipulating logs and blocks of wood.

Solutions have been proposed in other fields for the detection of materials other than wood. For example, German patent application DE 2946797AI proposes an apparatus which classifies small objects on the basis of the sound they produce and places them in different containers. The small objects fall along a groove-like track onto a plate and the sound thus produced is compared to that caused by a small reference object. This sound is utilized by a comparator unit which controls a small actuator which guides the falling small object into a given container. However, this prior system cannot be used for the separation of stones from a stream of logs and blocks of wood.

SUMMARY OF THE INVENTION

An object of the present invention is to provide a device which enables the separation of stones from a stream of wood on a conveyor without the use of a water-operated stone catcher. The device of the invention mainly consists of the conveyor, which is required in any case, to which has been added only the equipment needed for the detection and removal of stones.

Accordingly, the invention provides a device for separating hard objects from a stream of wood in an apparatus for conveying or manipulating logs or blocks of wood, which comprises: a conveyor section, at least one transducer capable of registering acoustic vibrations, a control unit connected to said at least one transducer by means of which hard objects conveyed along with the wood stream can be detected on the basis of the vibration signals they generate, and an exit gear incorporated in the apparatus for conveying or manipulating tree trunks and controlled by said control unit, so that said hard objects can fall down from the stream of wood passing through the apparatus.

BRIEF DESCRIPTION OF THE DRAWINGS

Further objects, features and advantages of the invention will become apparent to those skilled in the art from the following description thereof when taken in conjunction with the accompanying drawings, in which.

DESCRIPTION OF THE PREFERRED EMBODIMENTS

Figure 1:
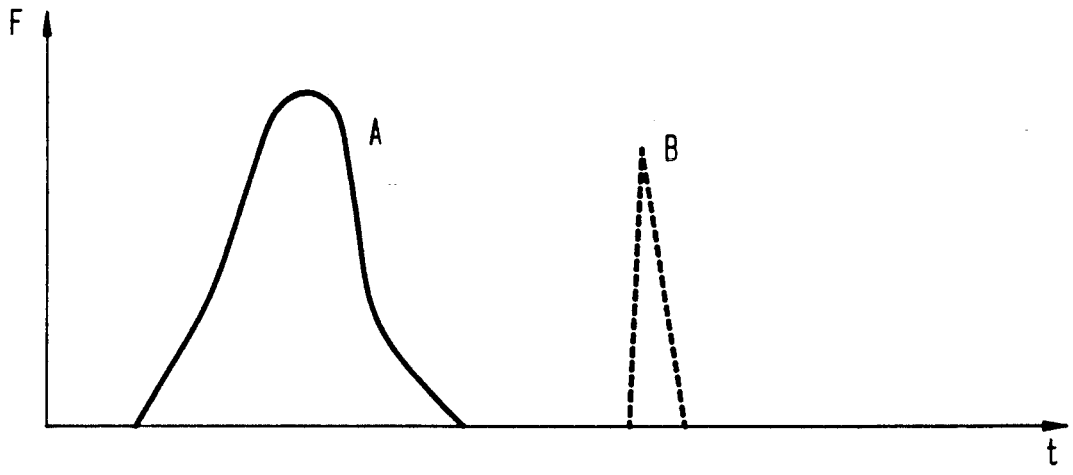
FIG. 1 shows graphically the forms of force impulses generated when a hard object hits a soft object (A) and when a hard object hits another hard object (B)
Figure 2:
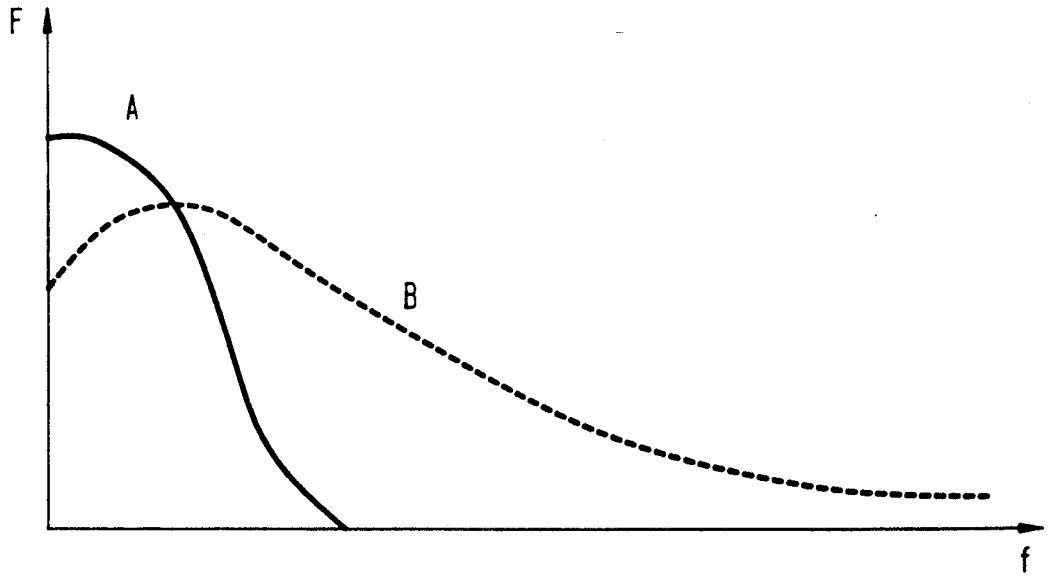
FIG. 2 shows graphically the frequency distribution (power spectral density) of force impulses as shown in FIG. 1, curve A representing a collision of a hard object and a soft object, and curve B representing a collision of two hard objects.
Figure 3:
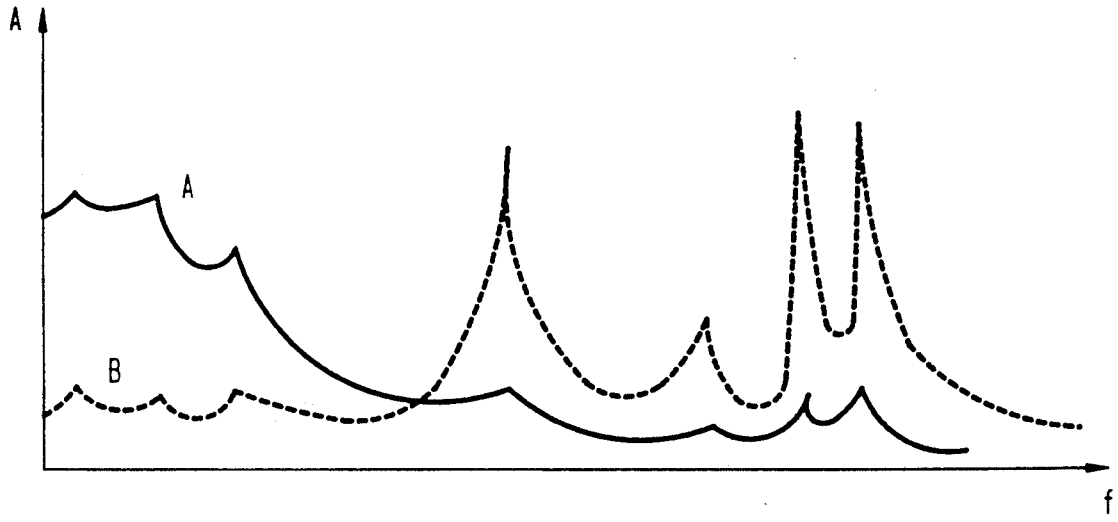
FIG. 3 depicts graphically the amplitude/frequency distribution of the vibration generated in a steel structure in an apparatus when hit by a wooden object A and, correspondingly, when hit by a hard object B.

When a wooden object collides with a metal structure, the force impulse generated is of a "soft" form and has a relatively long duration, as indicated by curve A in FIG. 1. In the frequency distribution of such an impulse (curve A in FIG. 2), the lower frequencies of vibration have larger amplitude values than the higher frequencies, as indicated by curve A in FIG. 3. The vibration frequencies generated by impacts from wooden objects are typical natural frequencies of large structural assemblies.

When a hard object such as a stone collides with a metal structure, the resulting force impulse is of a "sharp" form and is relatively short in duration, as indicated by curve B in FIG. 1. The range of vibration frequencies in the collision impulse is extended to higher frequencies, as shown by curve B in FIG. 2. As illustrated by curve B in FIG. 3, the amplitude distribution contains more high frequencies than in the case of a collision of wood and metal. These vibration frequencies produced in the metal structure by the impacts of hard objects are typically high local resonant frequencies of the surface of the structure.

Figure 4:
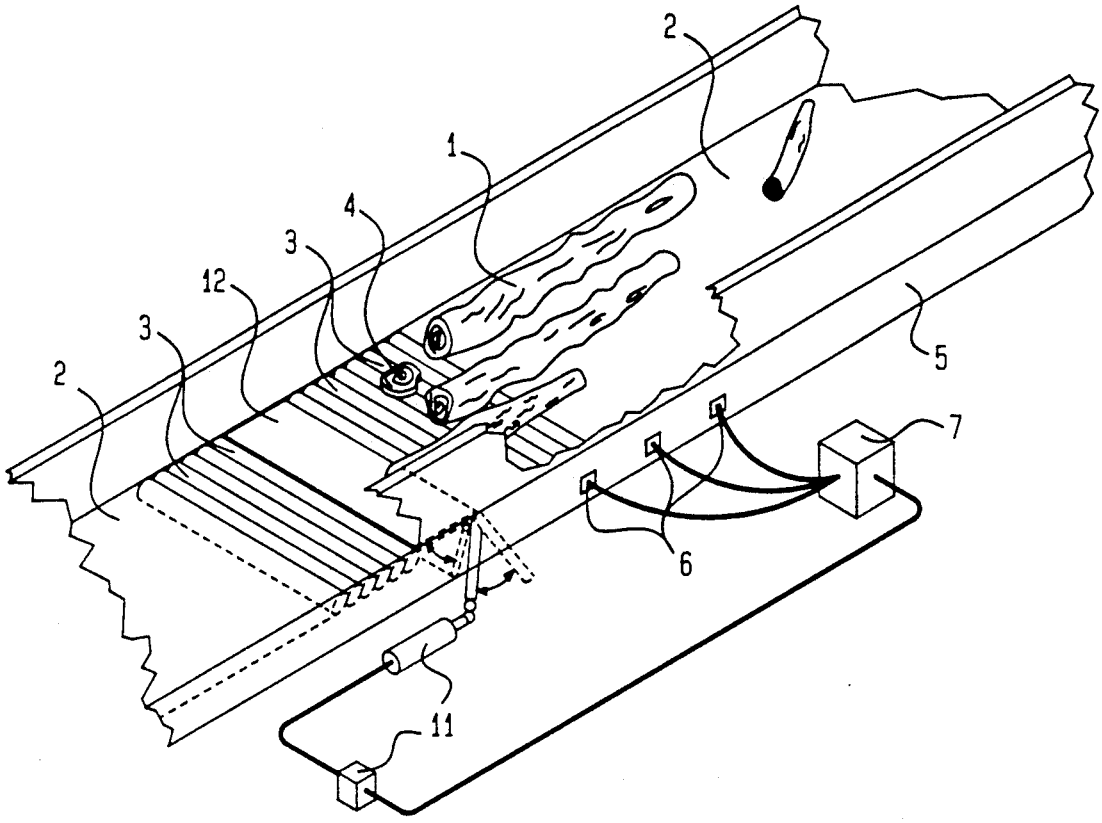
FIG. 4 is a diagrammatic perspective view of a device embodying the invention.

As an example of an embodiment of the invention, FIG. 4 shows part of a log conveyor on which a stone or other hard object 4 is carried along with logs and blocks of wood 1. As the stone 4 reaches steel conveyor rollers 3 in conveyor section 2, the impacts resulting from the stone hitting the rollers cause vibrations and sounds. These vibrations are identified by vibration transducers 6 attached to steel structure 5 of the apparatus and the vibration signals are processed by a measurement and control unit 7. When the hard object 4 thus detected reaches the location of an exit gear included in the device, the control unit 7 sends a command to an actuator 11 of an exit door 12, which is disposed between the rollers 3 at a point further downstream on the conveyor. After an adjustable delay depending on the speed of the conveyor, the actuator 11 opens the exit door 12, so that the stone 4 will fall down into a space below the conveyor.

The measuring point of one or more of the vibration transducer 6 used with the device of the invention may also be a bearing, the housing of a bearing, a supporting structure, a conveyor wall, or a plate, roller, bar, disc or similar metal object specifically designed for this purpose and preferably insulated against vibratory influences from the environment.

The vibration transducer 6 used in the device of the invention may also consist of a microphone, or the device may be provided with both a microphone and a vibration transducer 6. Via the medium of air, the microphone measures the sound generated by the mechanical vibration of the conveyor.

The device of the invention may be covered with sound insulation to reduce environmental background noise when a microphone is used for the detection of vibration.

Figure 5:
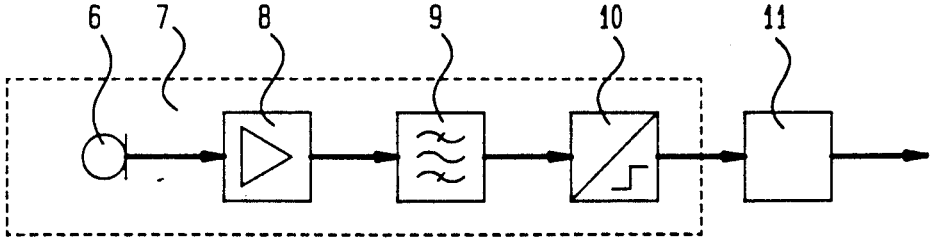
FIG. 5 is a block diagram showing schematically an embodiment of a signal processing unit.

FIG. 5 shows a block diagram of the signal processing unit used in an embodiment of the device of the invention. In addition to the vibration transducers 6, the measurement and control unit 7 comprises an amplifier 8, a filter 9 and a unit 10 for measurement of the r.m.s. value. The signal provided by the transducer 6 is amplified by the adjustable amplifier 8, whose output signal is filtered by a bandpass filter 9 to achieve a better signal-to-noise ratio. The filter 9 is so tuned that only vibrations caused by the impacts of hard objects are passed through, while vibrations caused by the impacts of wooden objects are not passed through at all or are considerably attenuated when they reach the next stage 10, where the r.m.s. value of the amplitude of the vibration signal is measured. The unit 10 measuring the r.m.s. value measures the signal strength in terms of an average value suitably obtained or a quantity proportional thereto, e.g. the r.m.s. value. When the signal strength exceeds a certain preset limit, the unit 10 measuring the r.m.s. value sends a control signal to the actuator 11, which then opens the exit door 12 to remove the stone 4.

Figure 6:
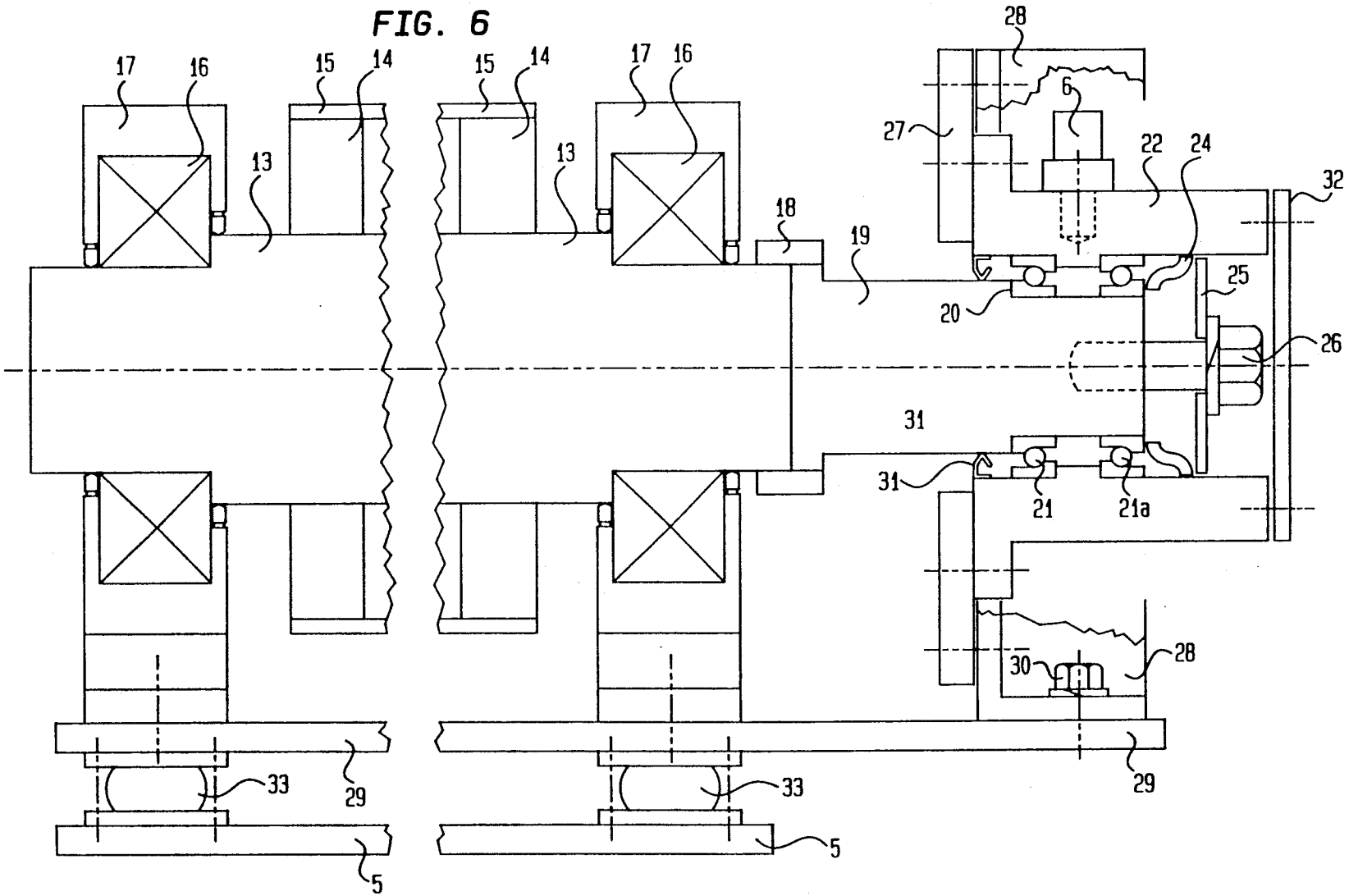
FIG. 6 is a cross-sectional view of an enlarged scale of a part of the device of FIG. 4.

A particular embodiment of the present device is shown in FIG. 6. In this embodiment, the main shaft 13 of roller 3 has attached by means of toroidal elements 14 the outer surface 15 of roller 3. Main shaft 13 is journalled at either end by means of bearing 16, running in bearing block 17. Main shaft 13 is extended by means of a coupler 18 and an extension shaft 19. Extension shaft 19 extends beyond the active area of the conveyor system, where shoulder 20 is found, and carries an angular contact bearings 21 and 21*a*. Alternatively, shaft 13 can be especially made for the purpose, and therefore coupling 18 would not be required. Bearings 21 and 21*a* may also be taper roller bearings. Bearing 21 is mounted on shaft 19 by its inner diameter and mounts into housing 22 by its exterior diameter. Bearing 21 is prevented from moving in one direction by shoulder 20 of shaft extension 19, and from moving in the other direction by circumferential ridge 23 which may be formed as part of housing 22, or be independantly formed and mounted by known means. Bearing 21*a* is prevented from moving in one direction by the ridge 23 and by pressure member 24, which may be a plate type spring washer. Pressure member 24 is held in place by circular plate 25, which is in turn, held in place by adjustment member 26, which may be a bolt. Housing 22 is mounted by a plurality of bolts to flexible member 27, which may be composed of a thick sheet of rubber or similar material, and which is in turn mounted to upright rigid members 28. Rigid members 28 are mounted to supporting plate 29 which is mounted on the conveyor frame 5 by means of bolts 30. Main shaft bearing housings 17 are mounted to support plate 29 as well. Plate 29 is mounted to the frame by means of flexible vibration dampers 33. Flexible sealing means 31 prevents unwanted material from entering the bearing chamber. Mounted into the wall of housing 22, is the vibration transducer 6, which may be of the accelerometer type. End plate 32, fastened to the end of housing 22, serves as a service port to adjust adjustment member 26, and as a means to prevent foreign material from entering the bearing chamber.

In this embodiment, bearings 21 and 21*a* are not load carrying bearings but act as a solid conduction means for the vibrations to be transmitted to detector 6 via housing 22. Axial movement of shaft 13 does not affect the detection means as the entire housing 22 is designed to be anchored to the shaft via bearings 21 and 21*a* and is flexibly supported by means of flexible member 27. All external vibrations from the frame and adjacent rollers are damped also by means of flexible member 27, so that only vibrations originating from materials contacting the roller surface 15 are transmitted to the detecting means 6. Signal discrimination means 7 to 10 of FIG. 5, previously described, then serve to process relevant signals and by means of actuator 11, control door means 12.

It will be obvious to a person skilled in the art that the invention is not restricted to the embodiments described above, but that the invention may instead be varied within the scope of the appended claims.

We claim:

1. A device for separating hard objects from a continuous stream of logs and/or blocks of wood in an apparatus for the continuous conveyance of logs and/or blocks of wood, which device comprises:

a. a metal conveyor section comprised of metal rollers for conveying said wood stream and a metal support structure for said metal rollers;

b. at least one vibration sensitive transducer in conductive contact with the metal conveyor section, for registering vibrations; said transducer being in conductive contact with a roller of said metal conveyor section, said roller being provided with an extended shaft means;

c. means operatively connected to said at least one vibration sensitive transducer for distinguishing between signals generated by at least one said transducer in response to impact of logs and/or blocks of wood and signals generated on impact of hard objects on said conveyor section, including means for distinguishing between the frequencies of vibration caused respectively by logs and/or blocks of wood and by hard objects;

d. a control unit which incorporates said distinguishing means, for generating a control signal by which hard objects conveyed along with the wood stream can be detected on the basis of the vibration signals they generate; and e. actuator means which upon receipt of a control signal from said control unit, activates an exit gear; said exit gear being controlled by said control unit through said actuator means, so that said hard objects fall out from a wood stream passing through the apparatus.

2. A device for the separation of hard materials from a continuous stream of logs and/or blocks of wood in accordance with claim 1, wherein said conveyor section includes a succession of conveyor rollers immediately preceding said exit gear, and said exit gear, includes an exit door which is opened and closed by said actuator means, said exit gear being located transversely relative to the direction of flow of the wood stream.

3. A device for the separation of hard materials from a continuous stream of logs and/or blocks of wood in accordance with claim. 1, wherein said control unit comprises an adjustable amplifier for amplifying the signal obtained from said at least one vibration transducer, distinguishing means consisting of a high frequency bandpass filter for filtering the amplified signal, and a unit for measuring the r.m.s. value of the amplified and filtered vibration signal.

4. A device for the separation of hard materials from a continuous stream of logs and/or blocks of wood in accordance with claim 3, wherein said unit measuring the signal r.m.s. value issues a control signal to the actuator means when the r.m.s. value of the vibration signal exceeds a certain preset limit.

5. A device for the separation of hard materials from a continuous stream of logs and/or blocks of wood in accordance with claim 4, wherein said unit delays the control signal to said actuator means by a predetermined amount of time.

6. A device for the separation of hard materials from a continuous stream of logs and/or blocks of wood in accordance with claim 1, wherein the extended shaft of the roller has at least one conduction bearing mounted on it, and wherein said at least one conduction bearing is spring loaded axially, and wherein said at least one conduction bearing is in turn mounted within a housing that is flexibly supported so as to be adjustable to different angles.

7. A device for the separation of hard materials from a continuous stream of logs and/or blocks of wood in accordance with claim 6, wherein said at least one vibration transducer is mounted into one of the walls of said housing in close proximity to said conduction bearings.

8. A device for the separation of hard materials from a continuous stream of logs and/or blocks of wood in accordance with claim 1, wherein the roller bearings and said flexible support of said housing are mounted on a support plate that is flexibly mounted to said metal support structure.

9. A device for the separation of hard materials from a continuous stream of logs and/or blocks of wood in accordance with claim 1, wherein said rollers, bearings for said rollers and a bearing housing are elastically insulated from said metal support structure.

10. A device for the separation of hard materials from a continuous stream of logs and/or blocks of wood in accordance with claim 1, wherein said conveyor section is elastically insulated from vibration from the remainder of the continuous conveyance apparatus.

11. A device for the separation of hard materials from a continuous stream of logs and/or blocks of wood in accordance with claim--1, wherein said at least one transducer is a microphone which measures acoustic vibrations of said rollers in response to impact by hard objects.

12. A device for the separation of hard materials from a continuous stream of logs and/or blocks of wood in accordance with claim 1, wherein said conveyor section is wholly covered with a sound insulating covering.

13. A device for the separation of hard materials from a continuous stream of logs and/or blocks of wood in accordance with claim 1, wherein said conveyor section is partially covered with a sound insulating covering.

14. A device for the separation of hard materials from a continuous stream of logs and/or blocks of wood in accordance with claim 1, wherein said extended shaft means is formed integrally with said roller.

15. A device for the separation of hard materials for a continuous stream of logs and/or blocks of wood in accordance with claim 1, wherein said extended shaft means is attached to said roller by means of a coupling.

* * * * *